US008943991B2

(12) United States Patent
Snow, Jr.

(10) Patent No.: US 8,943,991 B2
(45) Date of Patent: Feb. 3, 2015

(54) WATER SKIING AND WAKE-BOARDING APPARATUS

(75) Inventor: Joe W. Snow, Jr., Livermore, CA (US)

(73) Assignee: Joe W. Snow, Jr., Livermore, CA (US)

( * ) Notice: Subject to any disclaimer, the term of this patent is extended or adjusted under 35 U.S.C. 154(b) by 427 days.

(21) Appl. No.: 12/563,936

(22) Filed: Sep. 21, 2009

(65) Prior Publication Data

US 2011/0067616 A1 Mar. 24, 2011

(51) Int. Cl.
*B63B 21/56* (2006.01)
*F16L 3/01* (2006.01)
*B63B 35/81* (2006.01)

(52) U.S. Cl.
CPC ..... *B63B 35/815* (2013.01)
USPC ..... 114/253; 114/242; 114/250; 114/251; 114/243; 114/249; 114/254; 248/65; 248/61; 248/63; 248/74.1; 248/74.4; 248/218.4

(58) Field of Classification Search
USPC ..... 248/65, 61, 63, 74.1, 74.4, 218.4; 114/253, 242, 250, 251, 243, 249, 254; 116/174
See application file for complete search history.

(56) References Cited

U.S. PATENT DOCUMENTS

| | | | | |
|---|---|---|---|---|
| 649,367 | A * | 5/1900 | Seiler | 248/538 |
| 1,725,610 | A * | 8/1929 | Byl | 24/129 C |
| 2,924,193 | A * | 2/1960 | Bridges | 114/253 |
| 2,972,325 | A * | 2/1961 | Beltmann et al. | 114/253 |
| 3,326,175 | A * | 6/1967 | Baker | 114/254 |
| 3,802,374 | A * | 4/1974 | Brown | 114/254 |
| 3,919,963 | A * | 11/1975 | Cox, III | 114/253 |
| 4,892,276 | A * | 1/1990 | Alessio | 248/74.1 |
| 4,893,577 | A * | 1/1990 | Jennings | 114/253 |
| 5,000,109 | A * | 3/1991 | Anderson | 114/242 |
| 5,018,474 | A * | 5/1991 | Jellen | 114/253 |
| 5,190,256 | A * | 3/1993 | Macchiarella | 248/177.1 |
| 5,906,170 | A * | 5/1999 | Robertson | 114/254 |
| 6,708,377 | B2 * | 3/2004 | Maunder | 24/279 |
| 6,921,053 | B1 * | 7/2005 | Heck | 248/65 |
| 7,461,610 | B1 * | 12/2008 | Czepizak et al. | 114/218 |
| 7,883,121 | B2 * | 2/2011 | Henry | 285/410 |
| 2005/0186029 | A1 * | 8/2005 | Jones | 403/385 |
| 2005/0205722 | A1 * | 9/2005 | Krueger | 248/62 |
| 2007/0295867 | A1 * | 12/2007 | Hennon | 248/74.4 |

OTHER PUBLICATIONS

St. Patricks of Texas, "Sanitary Valves and Fittings", pp. 15, printed on Sep. 18, 2009 http://www.stpats.com/sanitaryfittings.htm.

* cited by examiner

*Primary Examiner* — Christopher Garft
(74) *Attorney, Agent, or Firm* — Blakely, Sokoloff, Taylor & Zafman LLP

(57) ABSTRACT

In one embodiment of the invention, a rope tender is rotatably affixed to the center pull on the tower to carry the rope over wakeboard racks. The rope tender is clamped to the center pull on the tower by a clamp. The rope is then pulled through an end loop on the rope tender and attached to the center pull on the tower. In one embodiment, the rope tender is looped one or more times in the middle to achieve a flexible, spring effect for the rope tender. The rope may also be pulled through the middle loop for support.

4 Claims, 3 Drawing Sheets

WATER SKIING AND WAKE-BOARDING APPARATUS

BACKGROUND

1. Field of the Invention

The present invention relates generally to water-skiing and wake-boarding equipment. More specifically, the invention relates to an improved apparatus and method for guiding a rope used for water-skiing, wake-boarding or other water-related sports.

2. Description of Related Art

As illustrated in FIG. 1, current boats used for wakeboarding have a tower 101 to which a rope 102 used for wakeboarding is connection. The tower 101 holds the rope high when the boat turns around to pick up a wake-boarder. One problem with current implementations is that, when the rope drops down, it tends to get caught on the wakeboard rack 103 bolted on the tower or other hardware within the vicinity of the rope 102.

SUMMARY

In one embodiment of the invention, a rope tender is rotatably affixed to the center pull on the tower to carry the rope over wakeboard racks. The rope tender is clamped to the center pull on the tower by a clamp. The rope is then pulled through an end loop on the rope tender and attached to the center pull on the tower. In one embodiment, the rope tender is looped one or more times in the middle to achieve a flexible, spring effect for the rope tender. The rope may also be pulled through the middle loop for support.

BRIEF DESCRIPTION OF THE DRAWINGS

The present invention is illustrated by way of example and not limitation in the figures of the accompanying drawings, in which like references indicate similar elements and in which.

DETAILED DESCRIPTION

Described below is an apparatus and method for supporting and guiding a rope used for water-skiing, wake-boarding and/or other water-related sports. Throughout the description, for the purposes of explanation, numerous specific details are set forth in order to provide a thorough understanding of the present invention. It will be apparent, however, to one skilled in the art that the present invention may be practiced without some of these specific details. While the discussion below focuses on a wake-boarding implementation, the underlying principles of the invention may be employed in various other contexts such as water-skiing.

Figure 1:
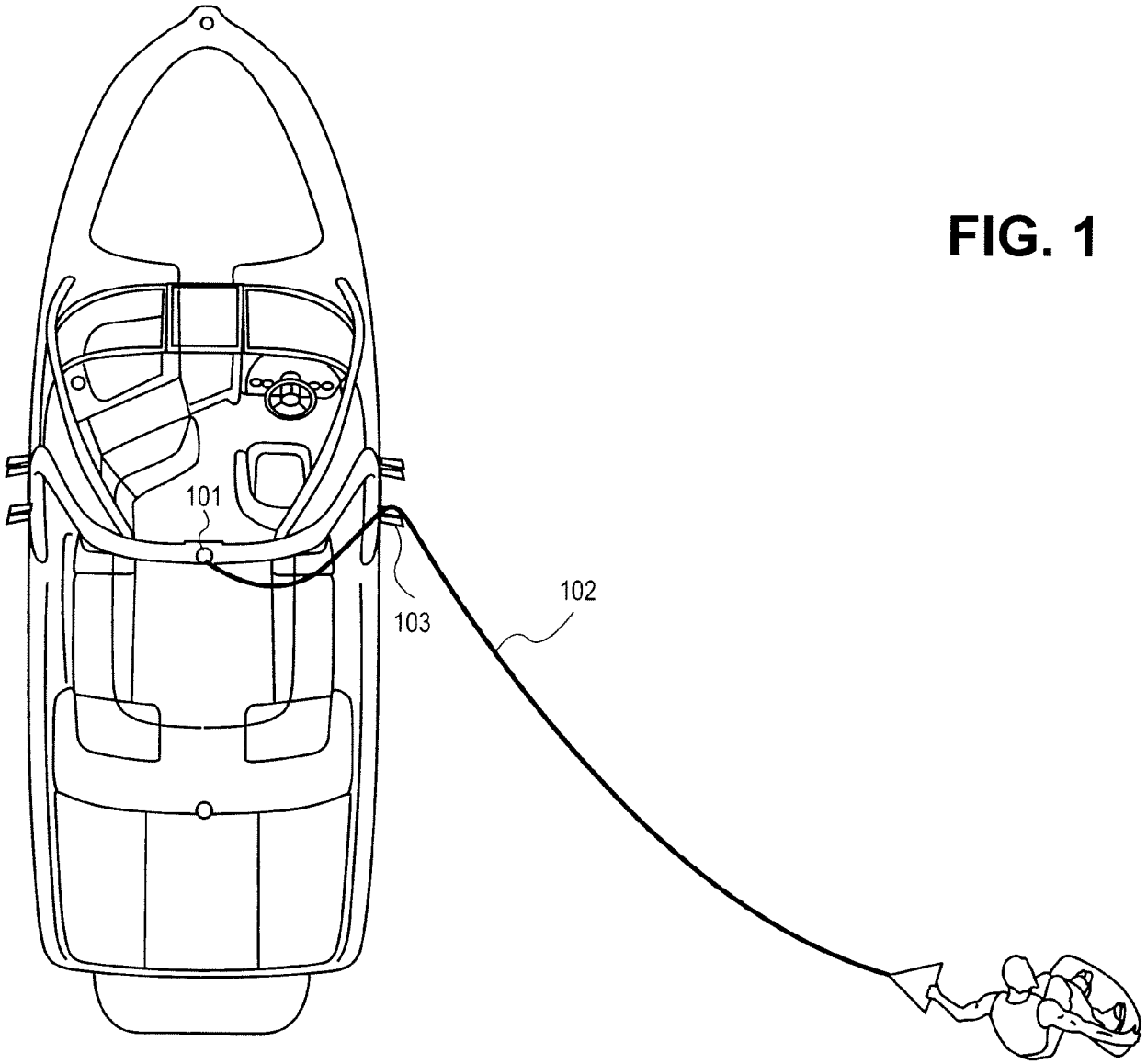
FIG. 1 illustrates a prior art implementation for wakeboarding.
Figure 2:
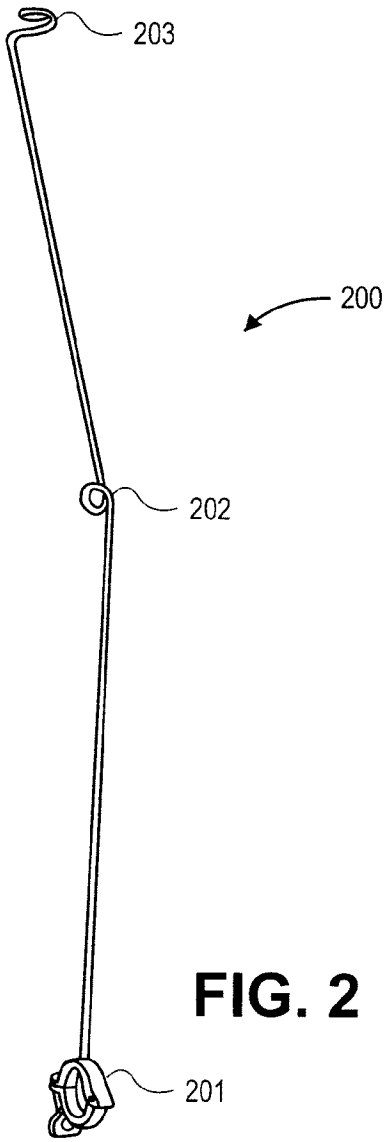
FIG. 2 illustrates a rope tender apparatus for supporting and guiding a rope according to one embodiment of the invention.
Figure 3:
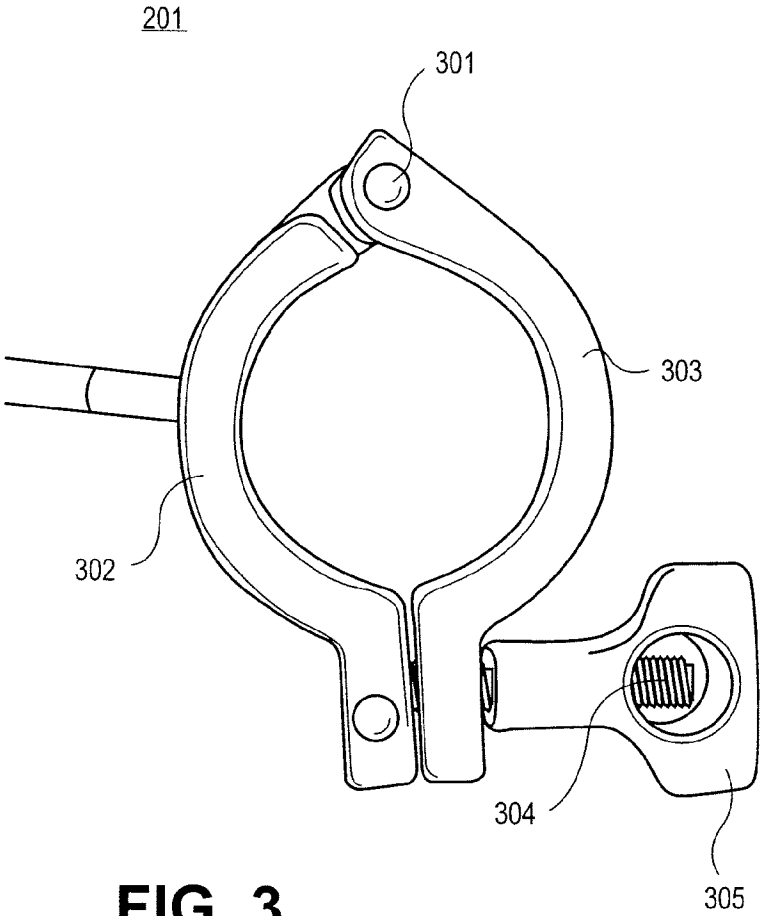
FIG. 3 illustrates a connection apparatus for connecting the rope tender to a boat.
Figure 4:
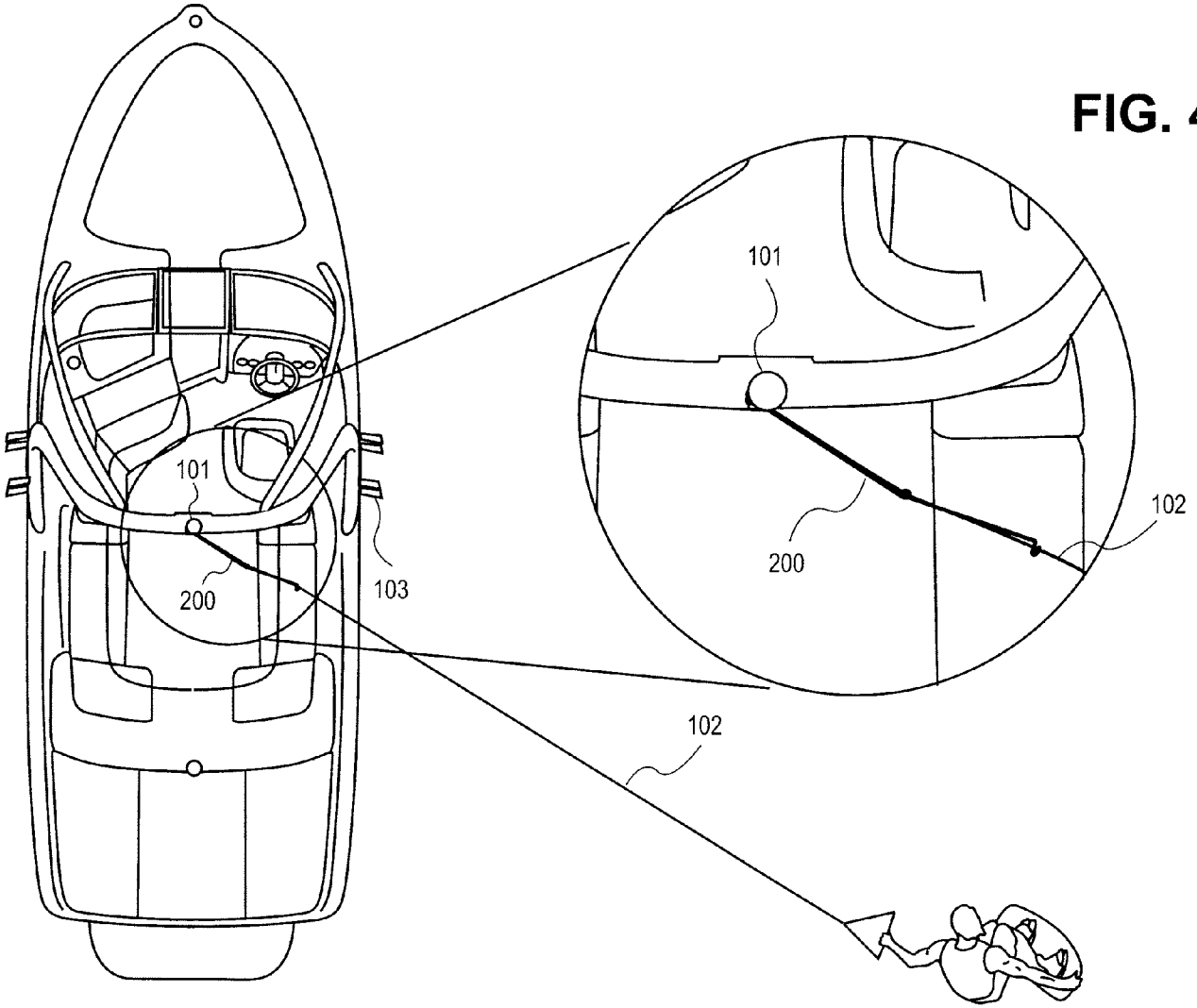
FIG. 4 illustrates a top view of the rope tender connected to a center pull of a tower.

As illustrated in FIG. 4, in one embodiment of the invention, a rope tender 200 is rotatably affixed to the center pull on the tower 101 to carry the rope over wakeboard racks. In one embodiment, the rope tender 200 is clamped to the center pull on the tower by the clamp 201 illustrated in FIGS. 2-3. The rope is then pulled through the end loop 203 on the rope tender 200 and attached to the center pull on the tower 101. In one embodiment, the rope tender is looped one or more times in the middle to achieve a flexible, spring effect for the rope tender 202. The rope may also be pulled through the middle loop 202 for support. The rope tender 200 rotates around the center pull on the tower 101, generally pointing in the direction of the rope tension (i.e., in the direction of the water-skier or wake-boarder).

As illustrated in FIG. 4, as the wake-boarder pulls the rope, the rope tender follows the pull. When the wake-boarder falls, the rope 102 drops low into the water. However, in contrast to prior wake-boarding implementations, as the boat turns around to pick up the wake-boarder, the rope tender holds the rope high so it does not catch on the wakeboard rack 103 or other hardware within the vicinity of the rope 102.

The particular clamp shown in FIG. 3 comprises a first rounded element 302 rigidly affixed to the rope tender, as shown, and rotatably coupled to a second rounded element 303 via a hinge connection 301. The hinge may be implemented using various known techniques including, but not limited to, a pin/hole configuration. A threaded bolt 304 is affixed to the first rounded element 302 and passes through a hole (not shown) in the second rounded element 303. A nut 305 includes internal threads which engage with the threads of the bolt 304 to apply a force to the second rounded element 303 and secure the first and second rounded elements around the center pull on the tower 101. In one embodiment, the clamp is a model 304 stainless, heavy duty single pin clamp currently available at www.stpats.com/sanitaryfittings.htm.

In one embodiment, the rope tender 200 and clamp 201 are formed from metal such as iron, steel, chromium, aluminum or any combination thereof. Alternatively, the rope tender 200 and/or clamp 201 may be formed from a plastic-based material, fiberglass, or any other type of rigid, flexible material. The underlying principles of the invention are not limited to any particular material for the rope tender 200 or clamp 201.

The rope-tender 200 is formed, in one embodiment, by twisting a long, rigid piece of metal at its approximate center to produce the middle loop 202 and at its end to produce the end loop 203. The long rigid piece of metal is cylindrical with an approximate diameter of ¼ of an inch. In addition, in one embodiment, the distance between the twisted end of the rope tender and the center twist is 18½ inches and the distance between the clamp and the center twist is 20¾ inches. In one embodiment, the diameter of the clamp 201 when fully clamped (as shown in FIG. 3) is 1¾ inches. Of course, the underlying principles of the invention are not limited to these particular dimensions. In fact, the size and style of the clamp 201 may be modified according to the particular tower to which it is meant to be attached.

The invention claimed is:

1. An apparatus comprising:

a clamp having a circular bore attaching around a center pull on a boating tower of a boat, the clamp comprising a first rounded element and a second rounded element coupled together by a hinge on a first end and having a bolt fixedly attached to a second end, the bolt having threads engaging with a nut for rotatably affixing the clamp around the center pull, wherein the first rounded element is rigidly and directly affixed to a rope tender for supporting and guiding a rope used for water-skiing or wake-boarding;

the rope tender rigidly affixed to the clamp and having an end loop and at least one twisted section comprising one or more additional loops to support a rope when the rope is pulled through the end loop and the one or more additional loops, the rope being usable to pull a wake-boarder or a water-skier, wherein the rope tender is fully rotatable around the center pull and has a length suitable for supporting the rope so that it does not catch on wakeboard racks or other hardware on the boat; and wherein the rope tender is flexible.

2. The apparatus of claim 1 wherein the clamp circular bore has an approximate diameter of 1¾ of an inch.

3. The apparatus of claim 2 wherein the rope tender comprises a metal cylinder having an approximate diameter of ¼ of an inch.

4. The apparatus of claim 3 wherein the one or more loops are in about a middle section of the rope tender.

* * * * *